US009010033B2

(12) United States Patent
Woods et al.

(10) Patent No.: US 9,010,033 B2
(45) Date of Patent: Apr. 21, 2015

(54) WALL RAIL SYSTEM

(75) Inventors: Donald Woods, Celestine, IN (US); Samial K. Johnson, Jasper, IN (US)

(73) Assignee: Kimball International, Inc., Jasper, IN (US)

( * ) Notice: Subject to any disclaimer, the term of this patent is extended or adjusted under 35 U.S.C. 154(b) by 99 days.

(21) Appl. No.: 13/352,425

(22) Filed: Jan. 18, 2012

(65) Prior Publication Data

US 2013/0180202 A1 Jul. 18, 2013

(51) Int. Cl.

| | |
|---|---|
| ***E04B 2/74*** | (2006.01) |
| ***E04F 13/26*** | (2006.01) |
| ***E04F 19/06*** | (2006.01) |

(52) U.S. Cl.

CPC ..... *E04F 13/26* (2013.01); *E04F 19/062* (2013.01); *E04B 2002/7483* (2013.01)

(58) Field of Classification Search

CPC ..... E04B 2002/7461; E04B 2002/7462; E04B 2002/7464; E04B 2002/7483; E04F 13/072; E04F 13/08; E04F 13/0803; E04F 13/0814; E04F 13/0821; E04F 13/0828; E04F 13/0889; E04F 13/0898; E04F 13/26; E04F 13/28; E04F 19/06; E04F 19/062; E04F 19/063; A47F 5/08; A47F 5/0846; A47F 5/0853; A47F 5/0807; A47F 5/0815; A47F 5/105; A47F 7/0042; A47F 96/067

USPC ..... 52/27, 36.1, 36.4, 36.5, 220.1, 220.2, 52/220.7, 239, 243, 243.1, 241, 242, 52/236.9, 238.1, 704, 710, 716.1, 717.01, 52/716.3, 716.4, 716.8, 718.01, 717.03, 52/459, 465, 460

See application file for complete search history.

(56) References Cited

U.S. PATENT DOCUMENTS

| | | | | |
|---|---|---|---|---|
| 2,947,093 | A | 8/1960 | Masters | |
| 3,425,568 | A * | 2/1969 | Albright | 211/87.01 |
| 3,566,561 | A * | 3/1971 | Tozer | 52/127.12 |
| 3,593,475 | A * | 7/1971 | LaGue | 52/241 |
| 4,513,941 | A | 4/1985 | Yamaguchi | |

(Continued)

FOREIGN PATENT DOCUMENTS

| | | |
|---|---|---|
| SE | 7810434 | 4/1980 |

OTHER PUBLICATIONS

Krug, "Virtu", Product Information Brochure, at least as early as Jan. 18, 2012.

(Continued)

*Primary Examiner* — Basil Katcheves
*Assistant Examiner* — Theodore Adamos
(74) *Attorney, Agent, or Firm* — Faegre Baker Daniels LLP

(57) ABSTRACT

A wall rail system for mounting to a wall within an office environment or work space, including a first, upper rail and a second, lower rail, each including a horizontally-facing channel. The rails further include vertically-facing channels, with the rails mountable to a wall in an inverted, opposing relationship with respect to one another with the vertically-facing channel of the upper rail facing in an upward direction, and the vertically-facing channel of the lower rail facing in a downward direction. Brackets secured to components such as a work surfaces or cabinets, for example, interface with the vertically-facing channels of the rails for mounting components to the rails without the use of fasteners. Decorative and/or functional tiles may be captured adjacent the wall between the rails using faceplates which engage the horizontally-facing channels of the rails.

24 Claims, 8 Drawing Sheets

(56) References Cited

U.S. PATENT DOCUMENTS

| | | | | | |
|---|---|---|---|---|---|
| 4,697,365 | A | | 10/1987 | Moosbrugger et al. | |
| 4,825,601 | A | | 5/1989 | Halverson | |
| 4,891,922 | A | | 1/1990 | Hozer et al. | |
| 4,961,295 | A | | 10/1990 | Kosch, Sr. et al. | |
| 4,986,332 | A | | 1/1991 | Lanuza | |
| 5,062,246 | A | | 11/1991 | Sykes | |
| 5,086,606 | A | | 2/1992 | Finses | |
| 5,184,441 | A | | 2/1993 | Balfanz, Jr. | |
| 5,228,579 | A | * | 7/1993 | Kaufman | 211/94.01 |
| 5,295,651 | A | | 3/1994 | Baker, Jr. | |
| 5,309,686 | A | * | 5/1994 | Underwood et al. | 52/29 |
| 5,353,571 | A | | 10/1994 | Berdan et al. | |
| 5,414,967 | A | * | 5/1995 | Cates et al. | 52/281 |
| 5,634,300 | A | * | 6/1997 | Huebner et al. | 52/36.1 |
| 5,806,261 | A | * | 9/1998 | Huebner et al. | 52/283 |
| 5,809,709 | A | * | 9/1998 | Ryan et al. | 52/222 |
| 5,941,026 | A | * | 8/1999 | Eisenreich et al. | 52/36.5 |
| 5,954,408 | A | | 9/1999 | Bogucki | |
| 6,012,258 | A | * | 1/2000 | Brown et al. | 52/239 |
| 6,065,262 | A | | 5/2000 | Motta | |
| 6,134,845 | A | | 10/2000 | Shipman et al. | |
| 6,167,676 | B1 | | 1/2001 | Shipman et al. | |
| 6,349,507 | B1 | * | 2/2002 | Muellerleile | 52/36.5 |
| 6,349,516 | B1 | | 2/2002 | Powell et al. | |
| 6,378,255 | B1 | | 4/2002 | Eich et al. | |
| 6,425,219 | B1 | | 7/2002 | Barmak et al. | |
| 6,510,635 | B1 | | 1/2003 | Rudolph et al. | |
| 6,553,731 | B2 | | 4/2003 | Hsueh | |
| 6,588,165 | B1 | * | 7/2003 | Wright | 52/506.05 |
| 6,631,813 | B1 | * | 10/2003 | Walter et al. | 211/94.01 |
| 6,807,784 | B2 | | 10/2004 | Hsueh | |
| 6,837,384 | B2 | * | 1/2005 | Secondino | 211/87.01 |
| 6,883,277 | B2 | | 4/2005 | Wiechecki et al. | |
| 7,086,542 | B2 | * | 8/2006 | Tomonari et al. | 211/94.01 |
| 7,104,023 | B1 | * | 9/2006 | Holztrager | 52/705 |
| 7,122,744 | B2 | | 10/2006 | Walter et al. | |
| 7,150,127 | B2 | | 12/2006 | Underwood et al. | |
| 7,310,918 | B1 | | 12/2007 | Reuter et al. | |
| 7,540,115 | B2 | | 6/2009 | Metcalf et al. | |
| 7,581,353 | B1 | | 9/2009 | Gill et al. | |
| 7,717,279 | B2 | * | 5/2010 | Lawson | 211/94.01 |
| 7,752,813 | B2 | | 7/2010 | Picchio | |
| 7,797,901 | B2 | | 9/2010 | Near | |
| 7,891,148 | B2 | | 2/2011 | Underwood et al. | |
| 7,908,805 | B2 | | 3/2011 | Metcalf et al. | |
| 7,921,615 | B2 | * | 4/2011 | Picchio | 52/238.1 |
| 2002/0053174 | A1 | | 5/2002 | Barmak | |
| 2002/0112411 | A1 | | 8/2002 | Gravel et al. | |
| 2005/0034378 | A1 | | 2/2005 | Underwood et al. | |
| 2007/0033894 | A1 | | 2/2007 | Underwood et al. | |
| 2009/0173016 | A1 | | 7/2009 | Metcalf et al. | |
| 2010/0175332 | A1 | | 7/2010 | Henriott | |

OTHER PUBLICATIONS

Hon, "Smartlink", Brochure and Product Information, 2010.
Bretford, "Here" Rail System, Brochure and Product Information, Apr. 21, 2005.

* cited by examiner

WALL RAIL SYSTEM

BACKGROUND

1. Field of the Disclosure

The present disclosure relates to wall rail systems for fitting out an interior space within an office building. More particularly, the present disclosure relates to a wall rail system that may be installed on a wall for use in mounting and locating wall tiles and other office furniture components.

2. Description of the Related Art

In an office environment, wall rails or tracks are used to mount office furniture components, such as work surfaces, cabinets, shelves, filing units, etc., to either a permanent wall or to an office partition system. One known track is formed as a single piece extrusion having a channel which is relatively wide in a vertical dimension. Brackets or other mounting hardware, which are separate from both the track and the accessory components, are used to mount accessory components to the rail.

Some known wall rails have a rather large, visible profile that may detract from the aesthetics of the office space, as well as increase the difficulty of handling and mounting the rails during installation. Other wall rail systems include a plurality of rails that are differently shaped in cross-section, with the various rails used at different heights along a wall, which adds to the total number of components required to install a complete system. Similarly, other rail systems have limited functionality in that each wall rail serves only a single, dedicated function, such as mounting a wall tile or a work surface, for example, which also necessitates the use of a number of different rails.

What is needed is a wall rail system that is an improvement over the foregoing.

SUMMARY

The present disclosure provides a wall rail system for mounting to a wall within an office environment or work space, including a first, upper rail and a second, lower rail, each including a horizontally-facing channel. The rails further include vertically-facing channels, with the rails mountable to a wall in an inverted, opposing relationship with respect to one another with the vertically-facing channel of the upper rail facing in an upward direction, and the vertically-facing channel of the lower rail facing in a downward direction. Brackets secured to components such as work surfaces or cabinets, for example, interface with the vertically-facing channels of the rails for mounting components to the rails without the use of fasteners. Decorative and/or functional tiles may be captured adjacent the wall between the rails using faceplates which engage the horizontally-facing channels of the rails.

In one form of the present disclosure, a wall rail system is provided, including a wall; a first, upper horizontal rail mounted to the wall, the first rail including a first horizontally-facing channel; a second, lower horizontal rail mounted to the wall beneath the first rail, the second rail including a second horizontally-facing channel and a downwardly and vertically-facing channel disposed beneath the second, horizontally-facing channel; a tile disposed between the first and second rails, the tile including an outer face, and an inner face disposed facewise adjacent the wall; and a pair of retaining elements respectively received within the first and second horizontally-facing channels, the retaining elements each at least partially overlapping the outer face of the tile.

In another form of the present disclosure, a wall rail system is provided, including a wall; a first, upper horizontal rail mounted to the wall, the first rail including a first horizontally-facing channel and an upwardly and vertically-facing channel disposed above the second, horizontally-facing channel; a second, lower horizontal rail mounted to the wall beneath the first rail, the second rail including a second horizontally-facing channel; a tile disposed between the first and second rails, the tile including an outer face, and an inner face disposed facewise adjacent the wall; and a pair of retaining elements respectively received within the first and second horizontally-facing channels, the retaining elements each at least partially overlapping the outer face of the tile.

In a still another form of the present disclosure, a wall rail system is provided, including a wall; a first, upper horizontal rail mounted to the wall, the first rail including a first horizontally-facing channel; a second, lower horizontal rail mounted to the wall beneath the first rail, the second rail including a second horizontally-facing channel; a tile disposed between the first and second rails, the tile including an outer face, and an inner face disposed facewise adjacent the wall; and a pair of retaining elements respectively received within the first and second horizontally-facing channels, the retaining elements respectively covering the first and second rails and each at least partially overlapping the outer face of the tile.

BRIEF DESCRIPTION OF THE DRAWINGS

The above-mentioned and other features of the disclosure, and the manner of attaining them, will become more apparent and will be better understood by reference to the following description of embodiments of the disclosure taken in conjunction with the accompanying drawings, wherein.

Corresponding reference characters indicate corresponding parts throughout the several views. The exemplifications set out herein illustrate embodiments of the disclosure and such exemplifications are not to be construed as limiting the scope of the disclosure in any manner.

DETAILED DESCRIPTION

Figure 1:
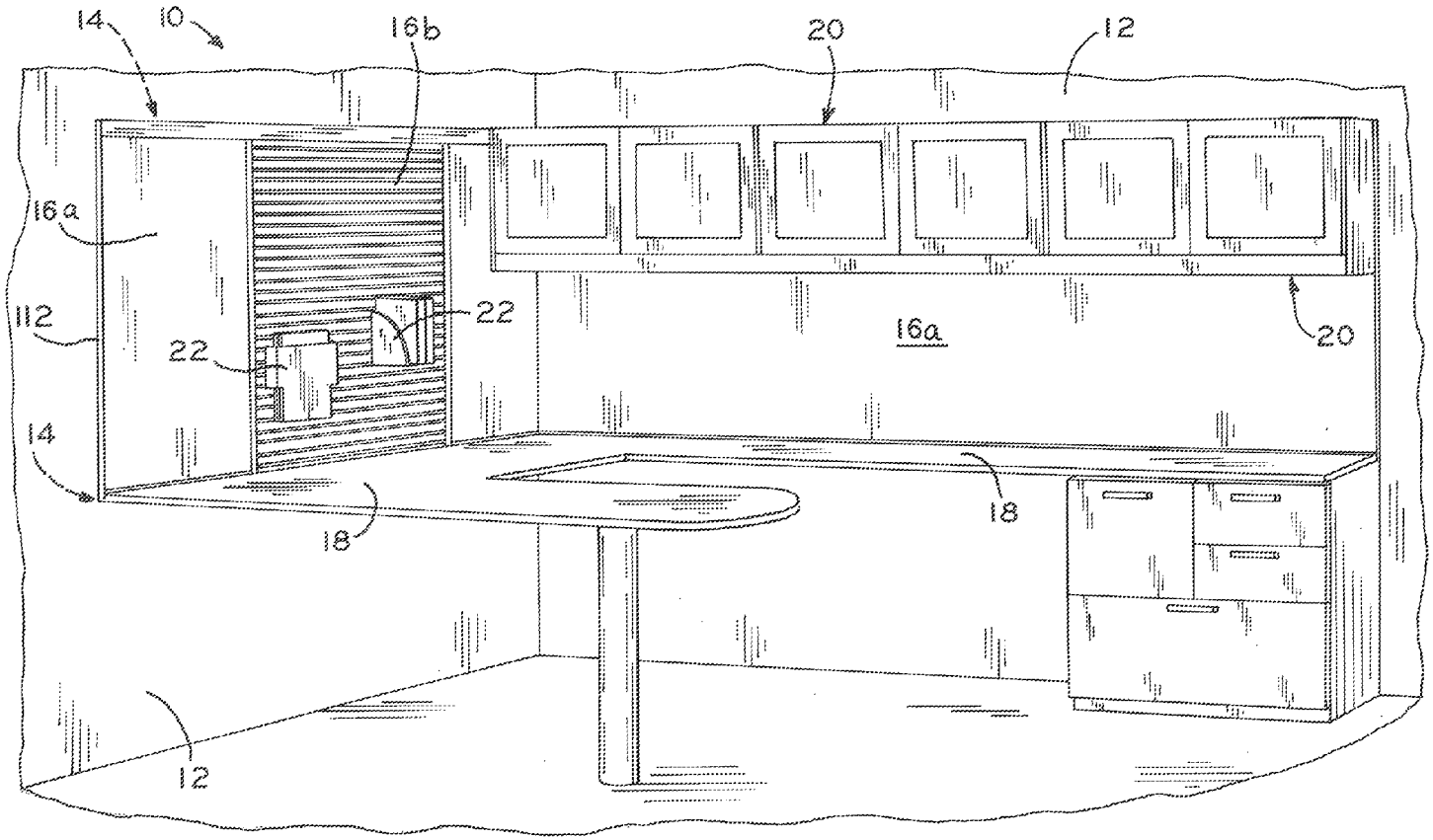
FIG. 1 is a perspective view of an exemplary office environment or workspace including the wall rail system of the present disclosure.

Referring now to FIG. 1, office environment or workspace 10 is shown, including the wall rail system of the present disclosure. Office environment or workspace 10 may include one or more walls 12, and rails 14 are mounted to walls 12 in the manner described below. The walls 12 to which the present wall rail system is mounted will typically be the permanent interior walls of a building, for example. However, the present wall rail system may also be mounted to, and therefore is also useable with, a movable office wall such as floor-to-ceiling partition system, or a movable office partition system panel of the type that does not extend completely from a floor to a ceiling.

Office furniture components such as tiles 16, work surfaces 18, and storage components such as cabinets 20, for example, may be mounted to walls 12 using the present wall rail system. Tiles 16 may be either aesthetic tiles 16*a* having a decorative and/or acoustic fabric covering, for example, or may be functional tiles, such as slat tile 16*b* which may be used to mount accessory items 22 such as organizers, shelves, etc. Tiles 16 may also be electrical and/or data tiles which include electrical and/or data outlets or ports to provide electrical and/or data service to the office environment or workspace 10.

Figure 2:
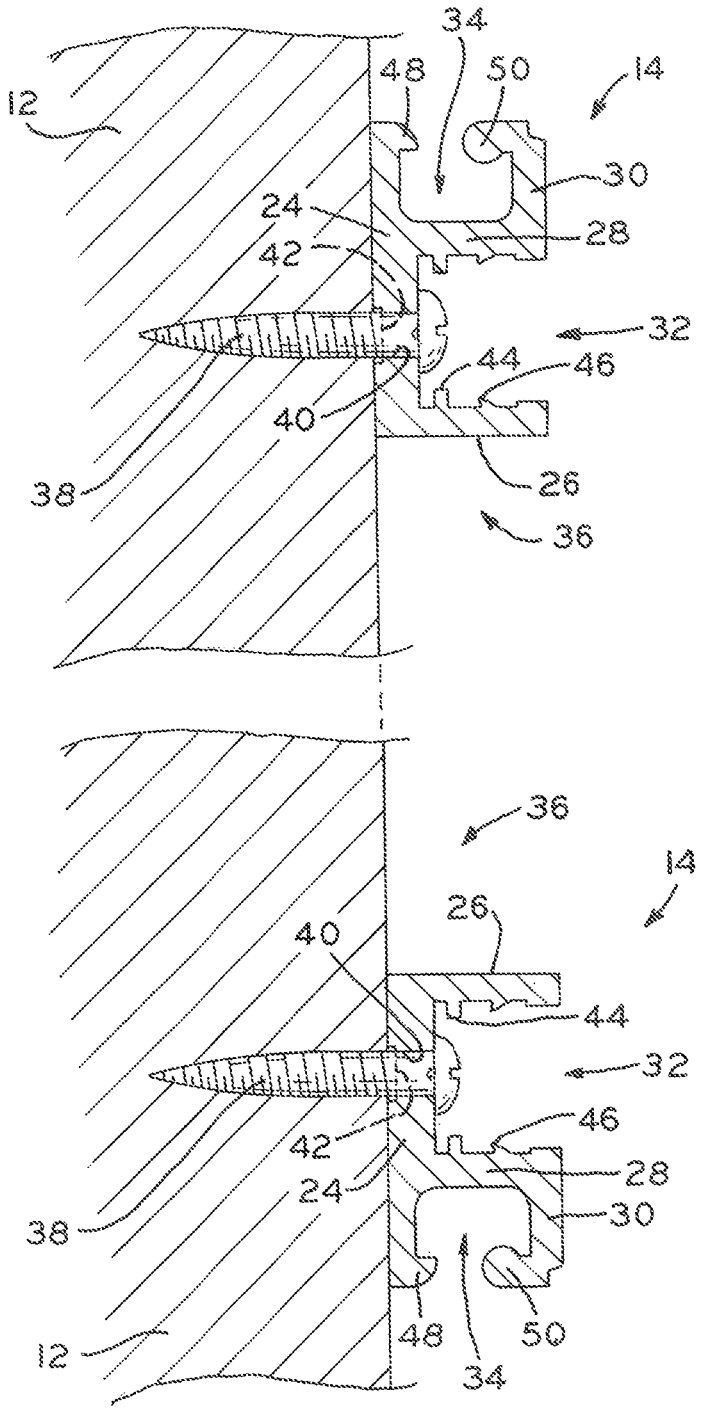
FIG. 2 is a sectional view showing a pair of upper and lower wall rails mounted to a wall.

FIG. 2 shows a cross-section of a pair of upper and lower rails 14 mounted to a wall 12. Rails 14 may be made of a rigid plastic or of a rigid metal such as extruded aluminum, for example. Upper and lower rails 14 may have identical cross-sections, with each rail 14 generally including rear wall 24, end wall 26, middle wall 28, and front wall 30. Each rail 14 also includes two different channels, namely, a horizontally-facing channel 32 defined by rear wall 24, end wall 26, and middle wall 28, and a vertically-facing channel 34 defined by rear wall 24, middle wall 28, and front wall 30. In particular, when rails 14 are mounted to a wall 12 as shown in FIG. 2, horizontally-facing channels 32 face outwardly in a horizontal direction. Further, rails 14 are mounted in an opposing, inverted relationship to one another such that the vertically-facing channel 34 of the upper rail 14 faces in an upward direction, and the vertically-facing channel 34 of the lower rail 14 faces in a downward direction, with the end walls 26 of the upper and lower rails 14 facing one another to define a tile-receiving space 36 between the upper and lower rails 14 adjacent wall 12 for accommodating tiles 16 in the manner described below.

As shown in FIG. 2, screws 38 or any other suitable fasteners may be used to secure rails 14 to wall 12 by abutting rear wall 24 of each rail 14 against wall 12, followed by threading screws 38 into wall through holes 40 provided in rear walls 24 of rails 14. Alternatively, rear walls 24 of rails 14 may include a small channel (not shown) open to the interior of horizontally-facing channel 32, such as a V-shaped channel in cross-section, which provides a reduced thickness area to aid in locating a drill bit for drilling holes through rear walls 24 of rails 14 at selected locations for receiving screws 38. Also, as may be seen in FIG. 2, end wall 26 and middle wall 28 each extend horizontally from rear wall 24 a distance beyond the heads of screws 38 when screws 38 are fully installed, which aids in concealing screws 38 and in preventing the interference of screws 38 with any components that are received within horizontally-facing channels 32. Rear wall 24 of rail 14 may also include a horizontally-elongated alignment line notch 42 on the side thereof facing wall 12, which is used to align rail 14 along a horizontal chalk line (not shown) or other alignment line, for example, which may be placed on wall 12 to aid in ensuring that rail 14 is mounted on wall 12 in a horizontally level alignment.

The horizontally-facing and vertically-facing channels 32 and 34, respectively, each include additional structural features. In particular, each horizontally-facing channel 32 further includes a pair of guide ridges 44 projecting toward one another from end and middle walls 26 and 28, respectively, which are disposed adjacent rear wall 24 and extend inwardly into channel 32. Each horizontally-facing channel 32 further includes a pair of faceplate-retaining ridges 46 projecting toward one another from end and middle walls 26 and 28, respectively, which are disposed adjacent front wall 30 and extend inwardly into channel 32.

Each vertically-facing channel 34 includes a support ridge 48 which is disposed at a distal end of rear wall 24 and extends inwardly from rear wall 24 into channel 34. A pivot ridge 50 is disposed at a distal end of front wall 30 and projects inwardly from front wall into channel 34 in facing relationship to support ridge 48. Pivot ridge 50 has a rounded or beaded profile for the purposes described below.

Figure 3:
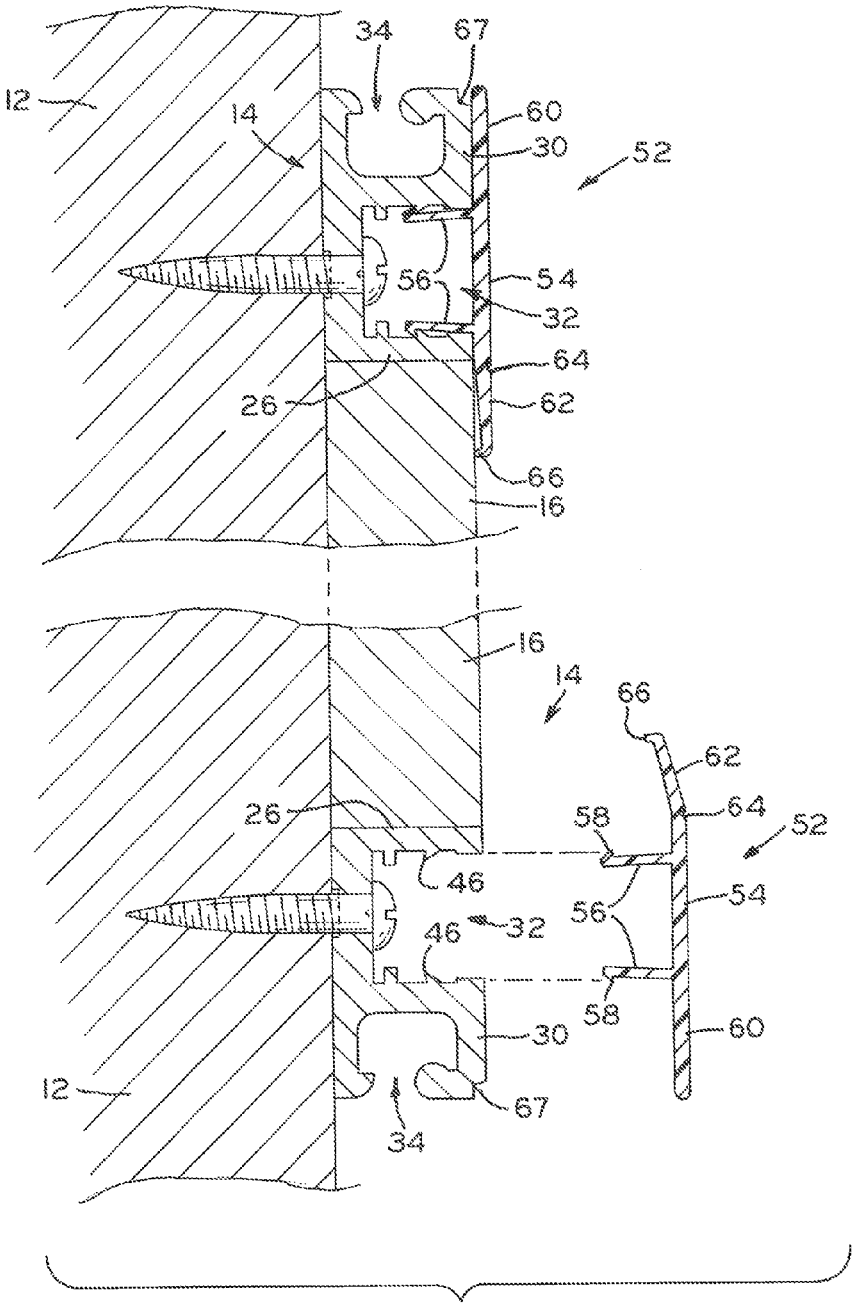
FIG. 3 is a sectional view similar to that of FIG. 2, further showing a tile and a pair of faceplates.

FIG. 3 is a cross-sectional view of a pair of upper and lower rails 14 supporting a tile 16 within the tile-receiving space (36, FIG. 2) between the upper and lower rails 14 via a pair of tile retaining elements, which are shown herein as faceplates 52. Tile 16 is first inserted or placed within the tile-receiving space between upper and lower rails 14 such that the lower edge of tile 16 rests atop end wall 26 of the lower rail 14, and the upper edge of tile 16 is disposed closely adjacent, or in contact with, end wall 26 of the upper rail 14. In this manner, rails 14 are mounted to wall 12 at a predetermined, spaced-apart distance to accommodate the height of tile 16 or alternatively, the tile 16 may be selectively sized to fit within the tile-receiving space between upper and lower rails 14. The thickness of tile 16 will typically be dimensioned to correspond to the length of end walls 26 of rails 14, though the thickness of tile 16 may be less and, in any event, tile 16 is disposed facewise adjacent wall 12 and will typically occupy most, or substantially all, of the tile-receiving space between the upper and lower rails 14 with tile 16 retained therein using faceplates 52 in the manner described below.

Still referring to FIG. 3, after tile 16 is received within the tile-receiving space between upper and lower rails 14, faceplates 52 are mounted within the horizontally-facing channels 32 of the upper and lower rails 14 to retain tile 16 in its position. In FIG. 3, a faceplate 52 associated with the lower rail 14 is shown in a pre-insertion position and another faceplate 52 associated with the upper rail 14 is shown mounted to channel 32 of the upper rail 14. Each faceplate 52 includes a substantially planar faceplate wall 54 having an outwardly-facing front face, as well as a rear face having a pair of engagement projections 56 extending therefrom with respective ends that terminate in engagement tabs 58. Faceplate wall 54 includes a first end 60 which is adapted to overlap the front wall 30 of a rail 14 when faceplate 52 is installed, together with a second, optionally flexible or resilient end 62 which is adapted to overlap with, and engage, the front face of a tile 16 when faceplate 52 is installed.

As shown in connection with the lower rail 14 in FIG. 3, after tile 16 is received and positioned within the tile-receiving space between the upper and lower rails 14, faceplates 52 are engaged with the horizontally-facing channels 32 of upper and lower rails 14 to retain tile 16 in position, as well as to cover horizontally-facing channels 32 and provide a clean aesthetic look along the interface between rails 14 and tile 16. In particular, after faceplate 52 is aligned such that its second end 62 faces tile 16, engagement projections 56 of faceplate 52 are inserted into the channel 32 of a corresponding rail 14, with engagement tabs 58 of engagement projections 56 initially engaging faceplate-retaining ridges 46 of channel 32 to cause engagement projections 56 to flex inwardly toward one another. With continued insertion, engagement tabs 58 clear ridges 46 to permit engagement projections 56 to bias outwardly to their original positions and thereby place engagement tabs 58 in engagement behind ridges 46 in the direction of insertion of faceplate 52 and thereby attach faceplate 52 to channel 32 of rail 14 in a snap-fit manner.

Also, during insertion of faceplate 52 in the manner described above, second end 62 of faceplate wall 54 may contact the front face of tile 16 and deflects slightly, as shown between the lower and upper faceplates 52 in FIG. 3. The deflection of second end 62 of faceplate 52 imposes a force on tile 16 that is directed inwardly toward wall 12 to aid in positively retaining tile 16 within the tile-receiving space between upper and lower rails 14.

Faceplates 52 may be made of a somewhat stiff, yet resilient plastic material, for example, with the flexibility of the engagement projections 56 and the second ends 62 of faceplate walls 54 facilitated by their thin profiles. Additionally, second ends 62 of faceplate walls 54 may each also include a small notch 64 at a base region thereof, as well as a beaded distal end 66 to engage tile 16. In another embodiment, faceplates 52 may be made of a rigid material, such as extruded aluminum, in which second ends 62 of faceplate walls 54 are not flexible, with tile 16 sized such that the front face of the tile 16 is engaged and retained in position by the beaded distal end 66 of faceplate wall 54 without flexing of second end 62 of faceplate wall 54.

Advantageously, each faceplate 52 can be fitted within a horizontally-facing channel 32 of a rail 12 in the snap-fit manner described above without the need for additional fasteners. Further, faceplate walls 54 of faceplates 52 cover channels 32 of rails 14, and first and second ends 60 and 62 of faceplate walls 54 also overlap front walls 30 of rails 14 and the edges of tiles 16, respectively, to completely cover rails 14 and provide a continuous, aesthetically pleasing look along the rail/tile interface.

In one embodiment, tile 16 may be mounted within tile receiving space 36 as follows. Referring to FIG. 3, after rails 14 are installed on wall 12, faceplate 52 may be attached to the upper rail 14 as described above. Thereafter, the upper edge of tile 16 may be inserted into the area of tile receiving space 36 (FIG. 2) which is disposed between wall 12 and faceplate 52, followed by moving tile 16 to a vertical position to support the weight of tile 16 on the lower rail 14. Thereafter, the lower faceplate 52 may be attached to the lower rail 14 in the manner described above to retain tile 16 in position.

Referring to FIG. 3, front wall 30 of rail 14 may additionally include a notch 67 at its distal end adjacent pivot ridge 50, which provides a clearance behind first end 60 of faceplate 52 for receipt of a suitable tool, such as a screwdriver, for example, to aid in removing faceplate 52 from its associated rail 14.

Figure 4:
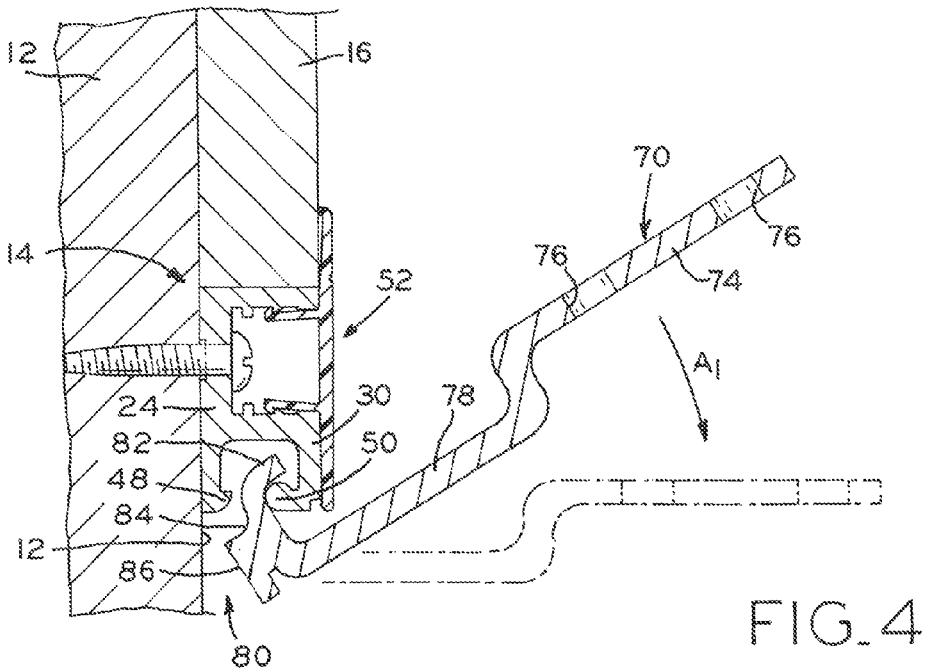
FIG. 4 is a sectional view showing a lower rail together with a work surface bracket, with a pre-installation or initial insertion position of the bracket shown in solid lines and a final, installed position shown in dashed lines.
Figure 5:
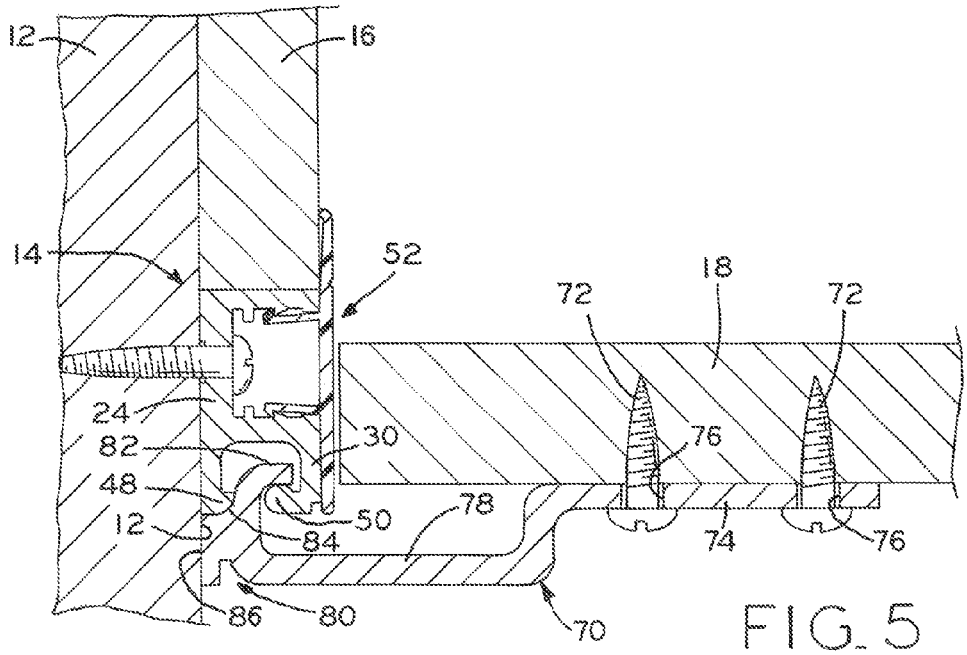
FIG. 5 is a sectional view similar to that of FIG. 4, showing the installed bracket together with a work surface mounted to the bracket.

FIGS. 4 and 5 show a cross-section of a lower rail 14 and work surface bracket 70. In particular, FIG. 4 shows work surface bracket 70 in a pre-insertion position in solid lines and in a final, installed position in dashed lies, and FIG. 5 shows work surface bracket 70 in its final, installed position together with a work surface 18 mounted to bracket 70 via a plurality of fasteners such as screws 72. Work surface bracket 70 includes an upper horizontal flange 74 having a plurality of holes 76 to which work surface 18 is mountable using screws 72, together with a lower horizontal flange 78 which is offset from upper flange 74. Work surface bracket 70 additionally includes a mounting portion 80 at a distal end of lower flange which is spaced from upper flange 74. Mounting portion 80 generally includes an engagement portion or engagement ridge 82, abutment recess 84, and abutment wall 86.

Referring to FIG. 4, to attach work surface bracket 70 within vertically-facing channel 34 of lower rail 14, mounting portion 80 of bracket 70 is initially aligned with channel as shown in solid lines FIG. 4, with engagement ridge 82 disposed within channel 34 and in abutment with pivot ridge 50 of front wall 30 of rail 14. In this position, bracket 70 is disposed in an upwardly angled or canted position as shown in solid lines in FIG. 4, and abutment recess 84 and abutment wall 86 are spaced from support ridge 48 of rear wall 24 of rail 14 and wall 12, respectively. Thereafter, bracket 70 is tilted downwardly along the direction of arrow $A_1$ to the horizontal position shown in dashed lines in FIG. 4, with engagement ridge 82 engaging and pivoting about pivot ridge 50 in a fulcrum-like manner.

Referring to FIG. 5, when bracket 70 reaches its horizontal position, abutment recess 84 abuts support ridge 48 of rear wall 24 of rail 14, and abutment wall 86 abuts wall 12. In this manner, the cooperating geometries of mounting portion 80 of bracket 70 and channel 34 of rail 14, together with wall 12, cooperate to retain mounting portion 80 of bracket 70 within channel 34 via a gravity-based clamping arrangement in which the weight of the bracket 70 itself, as well as the weight of work surface 18 attached to bracket 70, is distributed to pivot ridge 50 of front wall 30 of rail 14 as well as to support ridge 48 of rear wall 24 of rail 14 and to wall 12 in order to effectively clamp or brace bracket 70 in place and to prevent disengagement of bracket 70 from channel 34.

Also, as shown in FIG. 5, when work surface 18 is mounted to rail 14 with bracket 70, the rear edge of work surface 18 may be disposed closely adjacent to, and thereby in overlapping relationship with, faceplate 52. In this manner, an aesthetically continuous and clean view is presented to a user seated at work surface 18 because, as viewed from above work surface 18, the engagement of bracket 70 within channel 34 of rail 14 is hidden.

Figure 7:
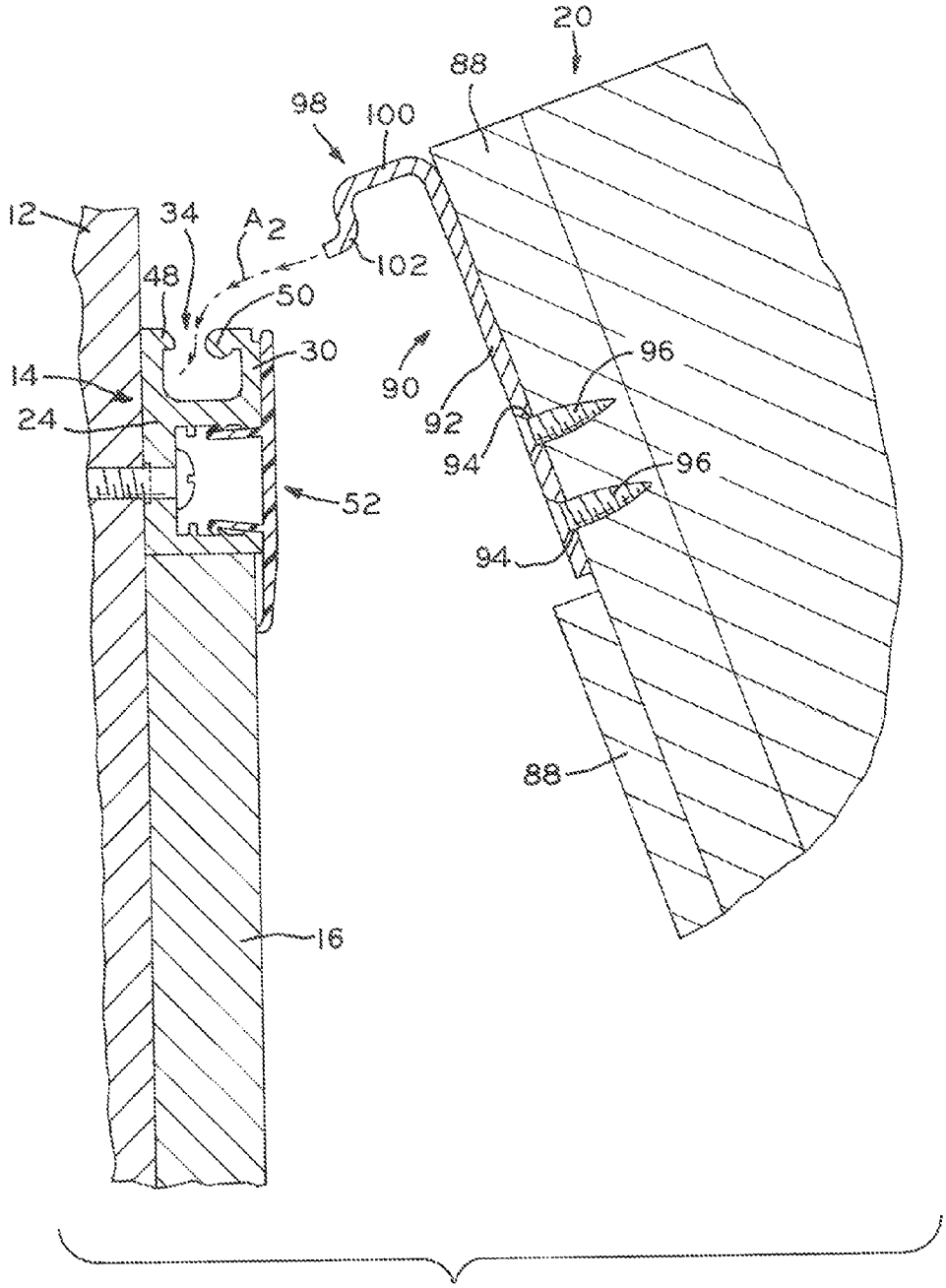
FIG. 7 is a sectional view illustrating an upper rail and a cabinet in a pre-mounted position.
Figure 8:
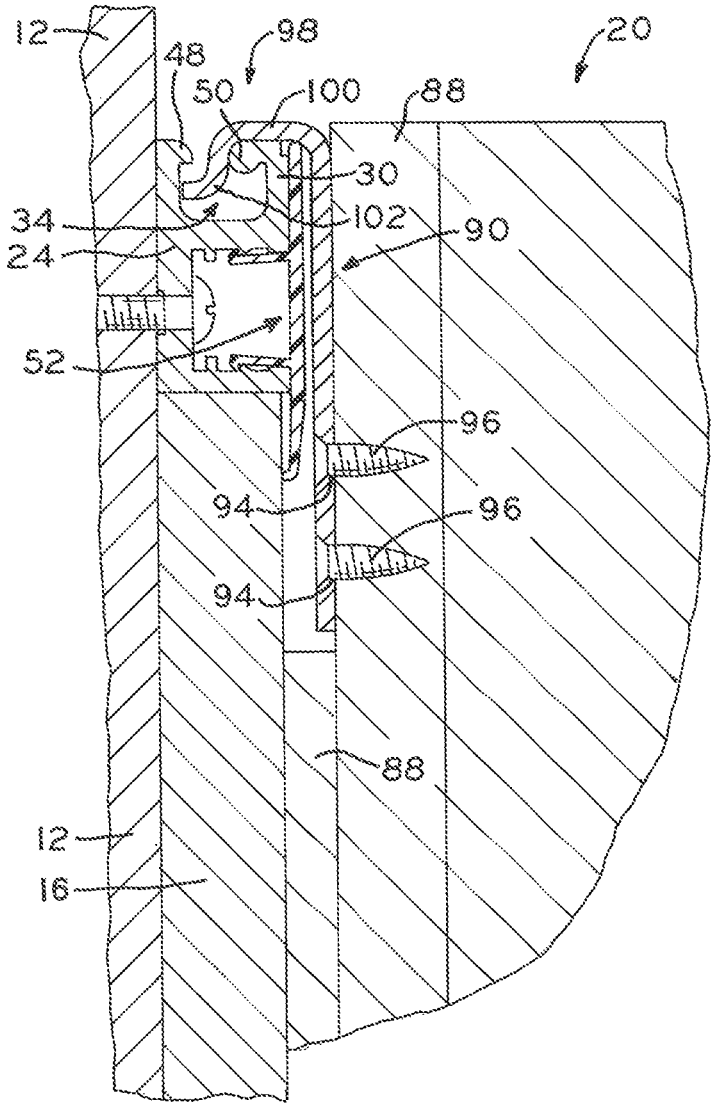
FIG. 8 is a sectional view similar to that of FIG. 7, showing the cabinet mounted to the upper rail.

Referring to FIGS. 7 and 8, the use of the vertically-facing channel 34 of an upper rail 14 for mounting an office furniture storage component 20, such as a cabinet, is shown and described. Cabinet 20 includes rear wall 88 to which mounting bracket 90 is attached. Mounting bracket 90 includes a vertical attachment portion 92 having a pair of holes 94 to accommodate screws 96 for securing bracket 90 to rear wall 88 of cabinet 20, together with a mounting portion 98 including horizontal wall 100 and an engagement hook 102. Referring to FIG. 7, engagement hook 102 may be inserted into channel 34 along the direction indicated by arrows $A_2$ with only minimal angular tilting of cabinet 20 from a vertical orientation required. As shown between FIGS. 7 and 8, when engagement hook 102 is inserted within channel 34, the weight of cabinet 20 is supported by the engagement of mounting portion 98 of bracket 90 with channel 30, particularly, by the engagement of horizontal wall 100 and engagement hook 102 around pivot ridge 50 of front wall 30 of rail 14, with support ridge 48 of rear wall 24 of rail 14 cooperating with engagement hook 102 to prevent disengagement of bracket 90 from channel 34.

Additionally, when cabinet 20 is moved from its tilted position to its final installed position after engagement of engagement hook 102 within channel 34, as shown between FIGS. 7 and 8, a lower portion of rear wall 88 of cabinet 20 engages tile 16 to aid in maintaining the position of cabinet 20 wherein engagement hook 102 of bracket 90 is braced or clamped within channel 34 in the position shown in FIG. 8. In this manner, as may be seen from FIGS. 7 and 8, office furniture components such as cabinet 20, which are typically heavy, can be easily mounted to rail 14 via bracket 90 without the use of additional fasteners and in a manner in which only a minimal tilting of cabinet 20 is required.

Figure 9:
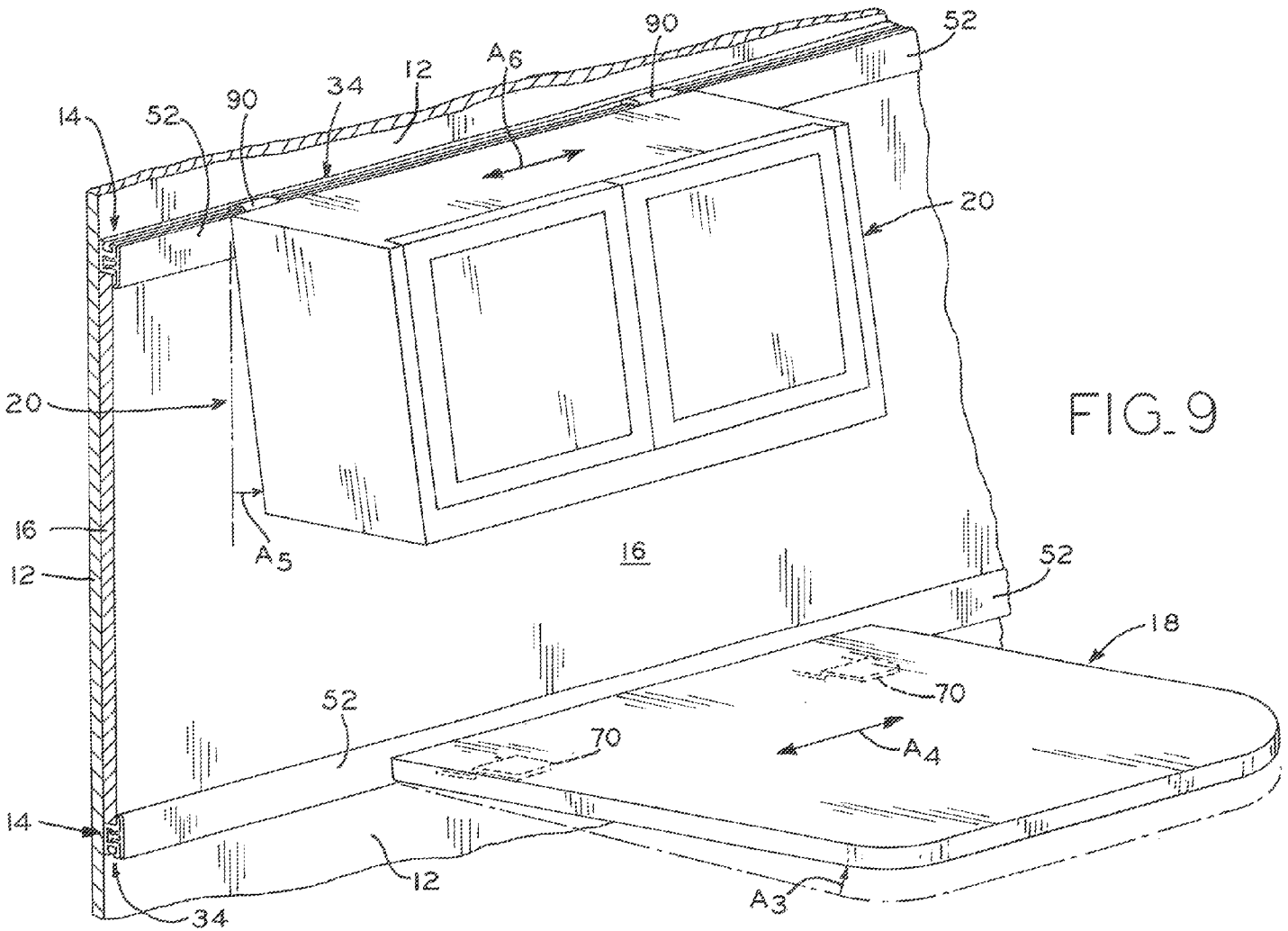
FIG. 9 is a perspective view illustrating the adjustment of the positions of the work surfaces and storage components along the rails.

Referring to FIG. 9, work surface bracket 70 and mounting bracket 90 also permit easy adjustment of the positions of their associated components. In particular, because brackets 70 and 90 are each mountable to a respective rail 14 in the manner described above, in which no fasteners are used to fix the position of the brackets 70 and 90 with respect to the rails 14, brackets 70 and 90 are easily and selectively locatable along the horizontal length of rails 14 to any desired position.

Referring to FIG. 9 and to FIGS. 4 and 5, to adjust the position of work surface 18 along its associated rail 14, work surface 18 is lifted slightly as indicated by arrow $A_3$ in FIG. 9 from the position shown in FIG. 5 toward the position shown in solid lines of FIG. 4 to disengage abutment recess 84 of bracket 70 from support ridge 48 of rear wall 24 of rail 14 and to disengage abutment wall 86 of bracket 70 from wall 12. Thereafter, as shown by arrow $A_4$ in FIG. 9, bracket 70 and work surface 18 may be slidably relocated horizontally along rail 14 with engagement ridge 82 of bracket 70 disposed within channel 34 of rail 14 to guide the movement of bracket 70 along rail 14.

In a similar manner, referring to FIG. 9 and to FIGS. 7 and 8, to adjust the position of cabinet 20 along its associated rail 14, cabinet 20 is lifted and tilted slightly as indicated by arrow $A_5$ in FIG. 9 from the position shown in FIG. 8 to disengage horizontal portion 100 of bracket 90 from pivot ridge 50 of front wall 30 of rail 14 and to disengage rear wall 88 of cabinet 20 from wall 16. Thereafter, as shown by the arrow $A_6$ in FIG. 9, bracket 90 and cabinet 20 may be relocated horizontally along rail 14 with engagement hook 102 disposed within channel 34 to guide the movement of bracket 90 along rail 14.

Once the desired position of the work surface 18 or cabinet 20 is established, the respective bracket 70 or 90 may be moved to its installed position as described above. As also shown in FIG. 9, an additional advantage to the structural configuration of rails 14 and brackets 70 and 90 is that, because brackets 70 and 90 interface with vertically-facing channels 34 of rails 14, the positions of work surfaces 18 and cabinets 20 may be adjusted along their respective rails 14 in the manner described above with faceplates 52 and tiles 16 remaining in place, because faceplates 52 interface with horizontally-facing channels 32 of rails 14.

Figure 6A:
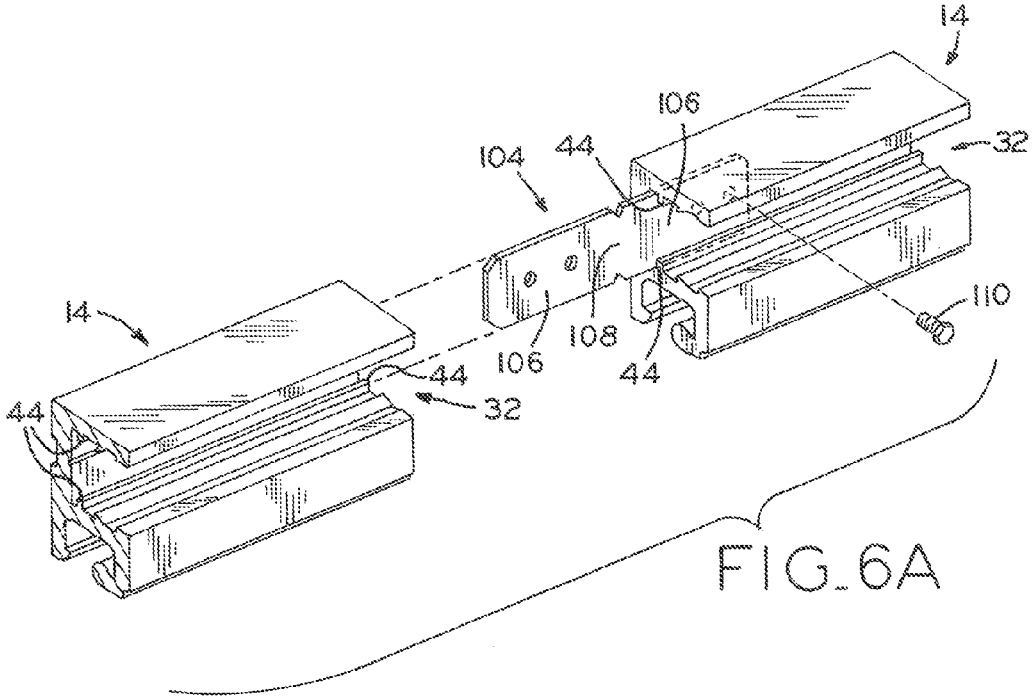
FIG. 6A is a partial perspective view showing a linear connection between a pair of wall rails using a splicing element.
Figure 6B:
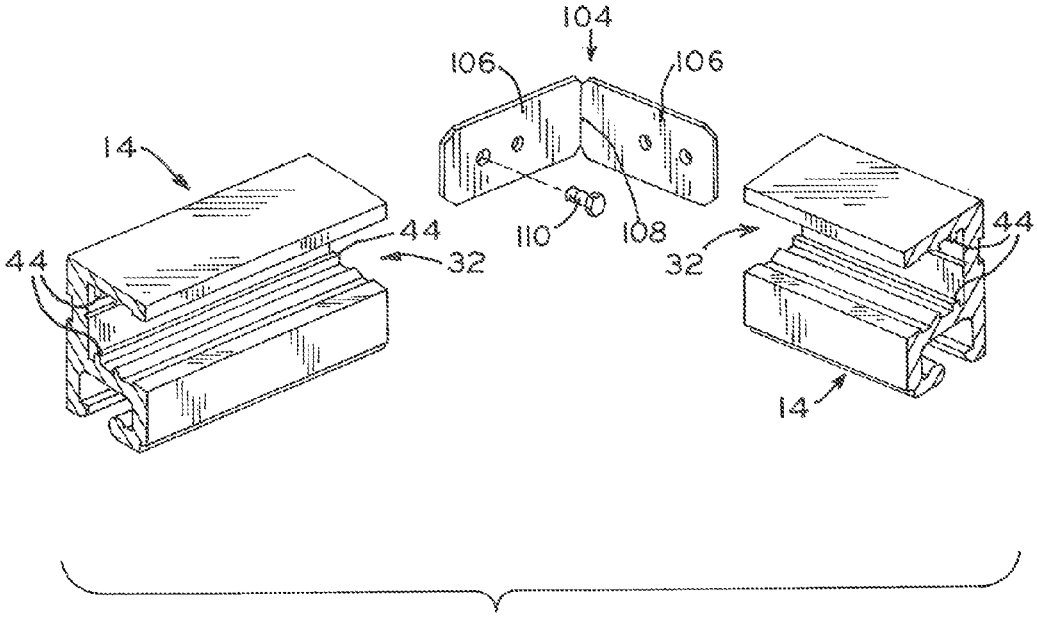
FIG. 6B is a partial perspective view showing a 90° or perpendicular connection between a pair of wall rails using a splicing element.

Referring to FIGS. 6A and 6B, a splice plate 104 is provided for splicing co-liner or in-line connections (FIG. 6A) or angled connections (FIG. 6B) between a pair of rails 14. Splice plate 104 includes a pair of plates 106 connected by a hinge portion 108 such that splice plate 104 is bendable along hinge portion 108 between the linear and angled configurations shown in FIGS. 6A and 6B, respectively. Plates 106 are each closely receivable within horizontally-facing channels 32 of rails 14 within the space provided between rear wall 24 and guide ridges 44 of channel 32. Additionally, fasteners such as screws or bolts 110 may be used to secure plates 106 to rails 14 to provide a more rigid connection between the foregoing components. In this manner, splice plates 104 maintain the horizontal alignment of rails 14 in co-linear or in-line connections (FIG. 6A) or angled connections (FIG. 6B). Further, the ends of rails 14 may be connected at any angle, such as the 90° angle shown in FIG. 6B or any acute or obtuse angle by selectively bending splice plate 104 along its hinge portion 108 to the selected angle. The ends of rails 14 may be miter cut, for example, to form a mitered 90° connection, with a splice plate 104 bent at 90° to maintain the horizontal alignment of rails 14 at such connection.

As shown in FIG. 1, a vertical end trim element 112 may be connected within the open ends of channels 32 and/or 34 of rails 14 to cover channels 32 and 34 and the ends of the tiles 16 to provide a clean, aesthetically pleasing look along the vertical edge of a run of rails 14.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A wall rail system, comprising:

a permanent wall;

a first, upper horizontal rail mounted to said wall via a plurality of fasteners, said first rail including a first horizontally-facing channel, a vertically disposed front wall spaced outwardly from said permanent wall and extending parallel to said permanent wall, and an upwardly and vertically-facing channel disposed above said first, horizontally-facing channel;

a second, lower horizontal rail mounted to said wall via a plurality of fasteners and disposed beneath said first rail, said second rail including a second horizontally-facing channel, a vertically disposed front wall spaced outwardly from said permanent wall and extending parallel to said permanent wall, and a downwardly and vertically-facing channel disposed beneath said second, horizontally-facing channel;

a tile disposed between said first and second rails, said tile including an outer face, and an inner face disposed facewise adjacent said permanent wall;

upper and lower retaining elements respectively received within said first and second horizontally-facing channels, said retaining elements respectively overlapping and including vertical walls in vertical engagement with respective said front walls of said first and second rails and each at least partially overlapping said outer face of said tile; and at least one of:

a bracket including a first, mounting portion received within said upwardly and vertically-facing channel of said first rail, and an attachment portion, and a cabinet mounted to said attachment portion; and a bracket received within said downwardly and vertically-facing channel of said second rail, said bracket including a horizontal flange, and a horizontally-disposed work surface attached to said horizontal flange.

2. The wall rail system of claim 1, wherein said first and second rails are identical in cross-section and are mounted to said wall in an inverted, opposing relationship with respect to one another.

3. The wall rail system of claim 1, wherein said retaining elements are faceplates each including a substantially planar faceplate wall covering a respective horizontally-facing channel, and at least one engagement projection extending from said faceplate wall and engaging within a respective said horizontally-facing channel.

4. The wall rail system of claim 1, wherein said faceplates each include a pair of said engagement projections resiliently engageable with respective ridges disposed interiorly within said horizontally-facing channels.

5. The wall rail system of claim 1, wherein said from walls of said first and second rails each include a notch providing a clearance between respective pairs of said front walls and retaining elements.

6. The wall rail system of claim 1, wherein said cabinet includes a rear wall in vertical overlapping relationship with said upper retaining element, said rear wall in direct engagement with said tile.

7. The wall rail system of claim 1, wherein said work surface includes a vertical rear edge disposed adjacent to, and in vertical overlapping relationship with, said lower retaining element and said second horizontally-facing channel of said second, lower horizontal rail.

8. A wall rail system, comprising:

a permanent wall;

a first, upper horizontal rail mounted to said wall via a plurality of fasteners, said first rail including a first horizontally-facing channel;

a second, lower horizontal rail mounted to said wall via a plurality of fasteners and disposed beneath said first rail, said second rail including a second horizontally-facing channel and a downwardly and vertically-facing channel disposed beneath said second, horizontally-facing channel, said vertically-facing channel at least partially defined by a front wall of said second rail, said front wall spaced outwardly from said permanent wall and including a first, vertical portion extending downwardly from said second rail and a second, horizontal portion extending from said vertical portion toward said permanent wall;

a tile disposed between said first and second rails, said tile including an outer face, and an inner face disposed facewise adjacent said permanent wall;

a pair of upper and lower retaining elements respectively received within said first and second horizontally-facing channels, said retaining elements each at least partially overlapping said outer face of said tile;

a bracket received within said downwardly and vertically-facing channel of said second rail, said bracket including a horizontal flange; and a horizontally-disposed work surface attached to said horizontal flange of said bracket, said work surface having a vertical rear edge disposed adjacent to, and in vertical overlapping relationship with, said lower retaining element and said second horizontally-facing channel of said second, lower horizontal rail.

9. The wall rail system of claim 8, wherein said bracket is retained within said downwardly and vertically-facing channel of said second rail by interfitting geometry between a mounting portion of said bracket and said second, horizontal portion of said second rail.

10. The wall rail system of claim 9, wherein said bracket includes a first portion received within said downwardly and vertically-facing channel of said second rail, and a second portion in abutment with said permanent wall.

11. The wall rail system of claim 8, wherein said retaining elements are faceplates each including a substantially planar faceplate wall covering a respective said horizontally-facing channel, and at least one engagement projection extending from said faceplate wall and engaging within a respective said horizontally-facing channel.

12. The wall rail system of claim 11, wherein said faceplates each include a pair of said engagement projections resiliently engageable with respective ridges disposed interiorly within said horizontally-facing channels.

13. The wall rail system of claim 8, wherein said first and second rails are identical in cross-section and are mounted to said wall in an inverted, opposing relationship with respect to one another with said first, upper rail including an upwardly and vertically-facing channel disposed above said first, horizontally-facing channel.

14. The wall rail system of claim 8, wherein said first and second channels each include a front wall spaced outwardly from said permanent wall and including a first, vertical portion extending vertically from a respective rail and a second, horizontal portion extending from said vertical portion toward said permanent wall, said front walls of said first and second channels each including a notch providing a clearance between respective pairs of said front walls and retaining elements.

15. The wall rail system of claim 8, wherein said lower retaining element includes a vertical wall in vertical engagement with said front wall of said second, lower horizontal rail.

16. Thew all rail system of claim 8, wherein said second, lower horizontal rail further comprises a rear wall which, together with said front wall, defines said downwardly and vertically-facing channel, said rear wall in abutment with said permanent wall and including a support ridge, said bracket in engagement with said support ridge.

17. A wall rail system, comprising:

a permanent wall;

a first, upper horizontal rail mounted to said wall via a plurality of fasteners, said first rail including a first horizontally-facing channel and an upwardly and vertically-acing channel disposed above said first, horizontally-facing channel, said vertically-facing, channel defined between a front wall and a rear wall of said first rail, said rear wall disposed adjacent said permanent wall and including a first, vertical portion extending upwardly from said first rail and a second, horizontal portion extending from said vertical portion away from said permanent wall;

a second, lower horizontal rail mounted to said wall via a plurality of fasteners and disposed beneath said first rail, said second rail including a second horizontally-facing channel;

a tile disposed between said first and second rails, said tile including an outer face, and an inner face disposed facewise adjacent said permanent wall;

a pair of upper and lower retaining elements respectively received within said first and second horizontally-facing channels, said retaining elements each at least partially overlapping said outer face of said tile;

a bracket including a first, mounting portion received within said upwardly and vertically-facing channel of said first rail, and an attachment portion; and a cabinet mounted to said attachment portion, said cabinet having, a rear wall in vertical overlapping relationship with said upper retaining element, said rear wall in direct engagement with said tile.

18. The wall rail system of claim 17, wherein said bracket is retained within said upwardly and vertically-facing channel of said first rail by interfitting geometry between a mounting portion of said bracket and said second, horizontal portion of said first rail.

19. The wall rail system of claim 17, wherein said retaining elements are faceplates each including a substantially planar faceplate wall covering a respective horizontally-facing channel, and at least one engagement projection extending from said faceplate wall and engaging within a respective said horizontally-facing channel.

20. The wall rail system of claim 19, wherein said faceplates each include a pair of said engagement projections resiliently engageable with respective ridges disposed interiorly within said horizontally-facing channels.

21. The wall rail system of claim 17, wherein said first and second rails are identical in cross-section and are mounted to said wall in an inverted, opposing relationship with respect to one another with said second, lower rail including a downwardly and vertically-facing channel disposed beneath said second, horizontally-facing channel.

22. The wall rail system of claim 17, wherein said first and second channels each include a front wall spaced outwardly from said permanent wall and including a first, vertical portion extending vertically from a respective rail and a second, horizontal portion extending from said vertical portion toward said permanent wall, said front walls of said first and second channels each including a notch providing a clearance between respective pairs of said front walls and retaining elements.

23. The wall rail system of claim 17, wherein said upper retaining element includes a vertical wall in vertical engagement with said front wall of said first, upper horizontal rail.

24. The wall rail system of claim 17, wherein said first, upper horizontal rail further comprises a rear wall which, together with said front wall, defines said upwardly and vertically-facing channel, said rear wall in abutment with said permanent wall and including a support ridge, said mounting portion of said bracket in engagement with said support ridge.

* * * * *